US005368010A

United States Patent [19]

Weber, III et al.

[11] Patent Number: 5,368,010

[45] Date of Patent: Nov. 29, 1994

[54] MULTI-POSITION FORCED AIR FURNACE

[75] Inventors: Richard H. Weber, III, Lafayette; Paul T. Richardson, Indianapolis; Gerald K. Gable, Carmel, all of Ind.

[73] Assignee: Consolidated Industries Corp., Lafayette, Ind.

[21] Appl. No.: 921,917

[22] Filed: Jul. 29, 1992

[51] Int. Cl.[5] ..... F24H 3/02

[52] U.S. Cl. ..... 126/110 R; 126/99 R; 126/116 R; 126/114

[58] Field of Search ..... 126/110 R, 99 R, 110 AA, 126/116 R, 116 B, 106, 109, 114; 237/50, 53, 2 R

[56] References Cited

U.S. PATENT DOCUMENTS

| | | | |
|---|---|---|---|
| 3,079,910 | 3/1963 | Bloom et al. . | |
| 3,111,939 | 11/1963 | Peoples . | |
| 3,358,672 | 12/1967 | Dirk et al. . | |
| 3,661,140 | 5/1972 | Raleigh . | |
| 3,774,587 | 11/1973 | Mutchler . | |
| 3,822,691 | 7/1974 | Mutchler . | |
| 4,467,780 | 8/1984 | Ripka . | |
| 4,739,746 | 4/1988 | Tomlinson . | |
| 4,751,910 | 6/1988 | Allen et al. | 237/55 X |
| 4,848,314 | 7/1989 | Bentley . | |
| 4,878,837 | 11/1989 | Otto . | |
| 4,883,423 | 11/1989 | Holowczenko . | |
| 4,899,726 | 2/1990 | Waterman . | |
| 4,926,840 | 5/1990 | Shellenberger et al. . | |
| 4,945,890 | 8/1990 | Ripka . | |
| 4,947,548 | 8/1990 | Bentley . | |
| 4,951,651 | 8/1990 | Shellenberger . | |
| 4,960,102 | 10/1990 | Shellenberger . | |
| 4,974,579 | 12/1990 | Shellenberger et al. . | |
| 5,042,453 | 8/1991 | Shellenberger . | |
| 5,060,722 | 10/1991 | Zdenek et al. . | |
| 5,062,409 | 11/1991 | Kamanaka et al. | 126/99 R |

*Primary Examiner*—Larry Jones

*Attorney, Agent, or Firm*—Victor E. Libert; Frederick A. Spaeth

[57] ABSTRACT

A single forced air furnace (10) may be installed in any of an upflow, downflow, or horizontal airflow orientation, with discharge of flue gases either opposite to or concurrent with the primary airflow path. The combination of design features which provides this versatility includes the following features: an inducer assembly (24) for withdrawing flue gas from the furnace heat exchanger (20), which inducer assembly (24) may be positioned to direct the discharge of flue gas in a selected one of a plurality of directions; an optional internal flue duct (64) for directing the flue gas through the furnace vestibule chamber then through the furnace housing (12); and the fact that the furnace housing (12) is dimensioned and configured so that the furnace may be supported on any one of four different sides (O, I, $S_1$, $S_2$) of the furnace housing (12).

13 Claims, 7 Drawing Sheets

MULTI-POSITION FORCED AIR FURNACE

BACKGROUND OF THE INVENTION

1. Field of the Invention

The present invention relates to forced air furnaces and in particular to forced air furnaces of the type used in residential installations.

2. Related Art

Conventional hot air furnaces such as those commonly installed to heat one- or two-family homes operate by forcing the air to be heated along a primary airflow path through a heat exchange chamber within which is disposed a heat exchanger. A blower forces the air past the coils of the heat exchanger to heat the air by indirect heat exchange, and thence through outlet ducts into the space to be heated. A system of return ducts serves to conduct return air from the heated space back to the blower for recirculation through the heat exchanger and reheating. The heat exchanger conventionally is heated by combustion product gases which are generated by a burner assembly positioned at the inlet to the heat exchanger coils and introduced into the heat exchanger. Combustion air may be provided to the burners by ambient air, for which purpose inlet ducts may be provided in the basement, attic or other enclosure or area in which the furnace is located. Fuel is supplied to the burners via a suitable fuel conduit, e.g., a pipe to conduct natural gas to the burners. The combustion product gases, after giving up heat to the primary air through the walls of the heat exchanger coils, are typically withdrawn from the heat exchanger outlet by a draft inducer blower and flowed via vent ducts to a chimney for discharge to the atmosphere. Accordingly, such furnaces must be coupled to outlet ducting to direct the heated air to the space (rooms) to be heated, to return ducting to direct air from the heated space back to the furnace for heating, to vent ducting to direct the cooled combustion product gases from the heat exchanger outlet to the chimney, to a fuel supply pipe, and sometimes to a combustion air supply duct.

Conventionally, manufacturers have carried a line of several differently configured furnaces in order to accommodate different types of installations. The space available for a furnace installation is usually limited and this and other considerations may dictate the use of any one of a number of installation configurations. To illustrate, the furnace may be installed as an upflow furnace, in which the primary air blower is below the heat exchanger and the primary airflow is directed upwardly from the furnace, as a down flow furnace, in which the primary air blower is above the heat exchanger and the primary airflow is directed downwardly from the furnace, or as a horizontal flow furnace, in which the primary air blower and heat exchanger are side by side and the primary airflow from the furnace is horizontally directed. Design and space considerations may require the outlet, return and vent ducting to be oriented in a particular direction relative to the furnace. For both upflow and downflow furnaces it is normally desired to direct the vent discharge, that is, the flue gases exiting from the heat exchanger, upwardly from the furnace to vent ducting. For horizontal primary airflow furnaces it may be desired to direct the flue gases either leftwardly or rightwardly from the furnace, thence to upwardly directed vent ducting. These factors have in the past required that different furnace designs be kept in inventory in order to accommodate different installation requirements, i.e., different combinations of horizontal, upwards or downwards primary airflow direction and horizontal and upwards vent discharge flow directions. Such choices may be dictated by the physical installation space within which the furnace is disposed, the design of the ducting which must be attached to the furnace, and other such considerations. For example, the building in which the furnace is to be installed may have pre-existing ducting in place so that the furnace must be configured in a manner which permits utilization of existing duct work, and/or limited space available for the furnace. Available space limitations may be severe, e.g., when the furnace is installed in a low-ceiling basement, in the rafters beneath a low roof attic, or within a small utility closet enclosure, etc.

Some attempts have been made in the prior art to enhance the versatility of furnaces with regard to installation. For example, U.S. Pat. No. 4,899,726 to Waterman, dated Feb. 13, 1990, discloses an inducer outlet elbow which directs combustion products from the inducer outlet to a flue. As seen in FIG. 2, where the inducer outlet is disposed upwardly, the inducer elbow 22 changes the direction of flow of the combustion products to the right about 90° from the direction of the inducer outlet. As discussed in column 4, lines 6–16, the elbow can be reversed on the inducer outlet to discharge the combustion products to the left.

U.S. Pat. No. 4,739,746 to Tomlinson, dated Apr. 26, 1988, discloses a heat exchanger for a furnace in which the direction of flow of combustion products through the heat exchanger relative to the flow of heated air in the primary airflow path through the heat exchange chamber may be reversed by inverting the heat exchanger elements. However, as is evident from a comparison of FIGS. 1 and 2 and the related text of column 4, lines 20–36, the inversion of the heat exchanger elements requires a dismantling and reinstallation of the burner assembly and the inducer assembly. In particular, as illustrated in FIGS. 1 and 2, the inducer outlet is disposed upwardly regardless of which heat exchanger configuration is used.

SUMMARY OF THE INVENTION

In accordance with the present invention there is provided an improvement in a forced air furnace comprising a housing defining an outlet side, an inlet side disposed opposite to the outlet side and a pair of oppositely disposed lateral sides. There is disposed within the housing a burner assembly, a heat exchange chamber, a heat exchanger disposed within the heat exchange chamber and having an exchanger inlet positioned to receive therein hot combustion product gases generated by the burner assembly, and an exchanger outlet for discharge of the combustion product gases therefrom. The housing further defines a blower chamber within which is disposed a primary air blower for forcing air in a primary airflow path through the heat exchange chamber in indirect heat exchange relationship with the heat exchanger, and a vestibule chamber extending adjacent to the heat exchange and blower chambers. An inducer assembly is disposed within the vestibule chamber and comprises an inducer blower and an inducer outlet, the inducer assembly being coupled in gas flow communication with the exchanger outlet for drawing cooled combustion product gases as flue gas from the heat exchanger. The improvement provided by the present invention comprises the following features: the inducer assembly is dimensioned and configured so that it can be coupled to the heat exchanger outlet with the inducer outlet disposed in a selected one of a plurality of directions relative to the vestibule chamber; the vestibule chamber is dimensioned and configured to accommodate an internal flue duct coupled to the inducer outlet and extending through the vestibule chamber from the inducer outlet to and through a side of the housing; and the housing is dimensioned and configured so that the furnace may be supported on any one of the outlet side, the inlet side and each of the lateral sides.

In accordance with another aspect of the present invention, the vestibule chamber has a first discharge section and a second discharge section opposite the first discharge section, and the inducer assembly is dimensioned and configured to enable selective placement of the inducter outlet facing toward either the first or second discharge sections.

Another aspect of the present invention provides that the first discharge section is disposed adjacent to the heat exchange chamber, the second discharge section is disposed adjacent to the blower chamber and opposite to the first discharge section, and the inducer assembly is disposed adjacent to the first discharge section.

Still another aspect of the present invention provides that the inducer assembly comprises an inducer pan which mates in gas flow communication with the exchanger outlet, the inducer pan and the exchanger outlet being each dimensioned and configured to have a common axis of symmetry whereby the inducer pan mates with the exchanger outlet in each of two rotational orientation positions of the inducer pan which positions are 180° of rotation apart about the axis of symmetry.

Related aspects of the present invention provide that the two positions of the inducer pan dispose the inducer outlet facing in respective opposite directions, both of which are parallel to the primary airflow path. A furnace according to the present invention may comprise an outer door, and the housing and the outer door may be dimensioned and configured so that the outer door may be mounted on the housing in each of two rotational orientation positions, the positions being 180° of rotation apart.

Yet another aspect of the present invention provides for an internal flue duct connecting the inducer outlet in flow communication with the second discharge section.

Other aspects of the invention are described below.

DETAILED DESCRIPTION OF THE INVENTION AND PREFERRED EMBODIMENTS THEREOF

Figure 1:
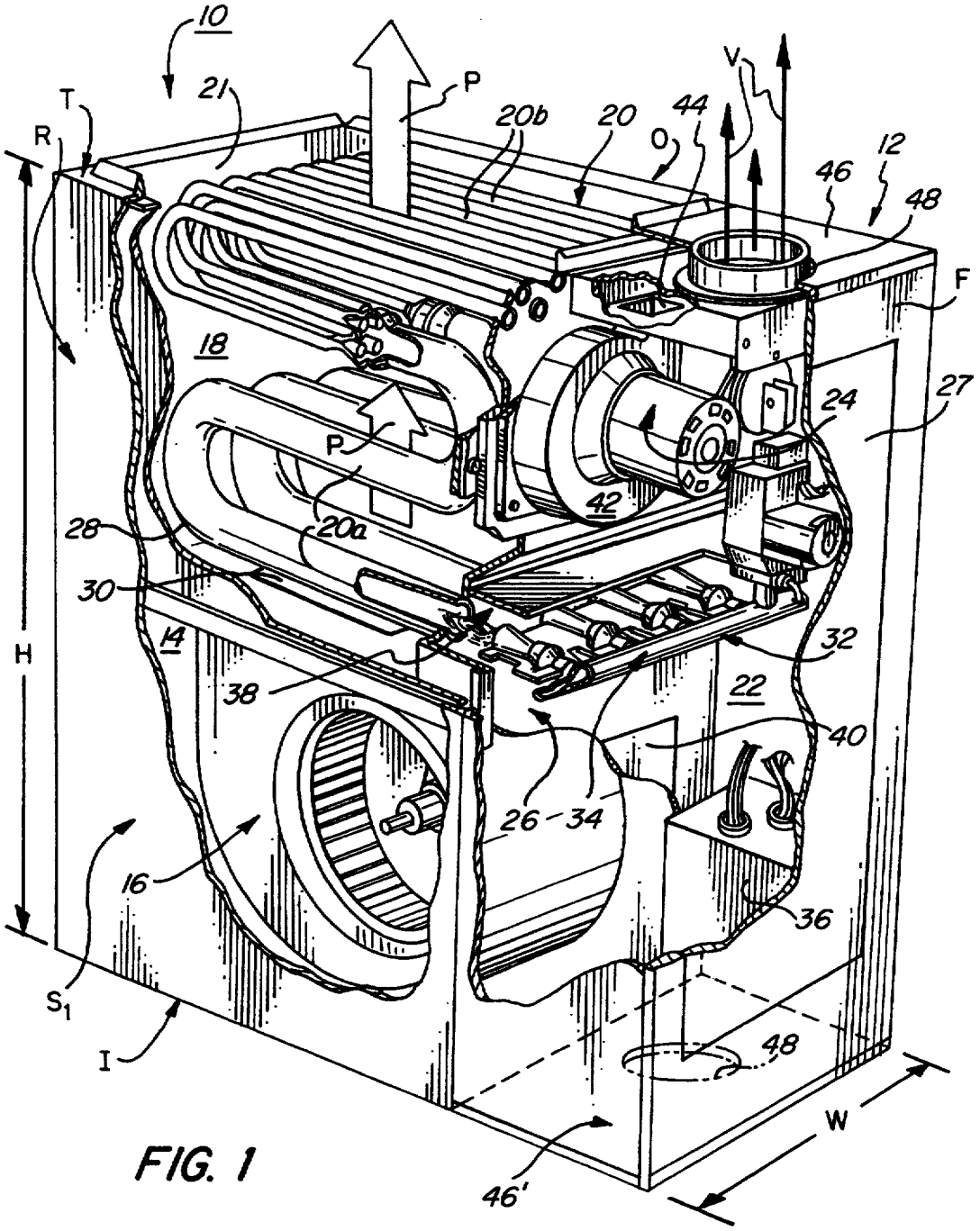
FIG. 1 is a schematic perspective view, with parts broken away, of a furnace according to one embodiment of the present invention.

Furnaces according to the present invention generally provide a housing which is divided into three chambers, a heat exchange chamber containing a heat exchanger, a blower chamber containing a primary air blower and a vestibule chamber. The blower and heat exchange chambers define a primary airflow path through the furnace, the primary air entering an inlet side of the furnace and exiting from an outlet side.

The vestibule chamber extends along one side of the heat exchange and blower chambers and contains other components of the furnace including, for example, a burner assembly for combusting any suitable fuel, such as natural gas, and introducing the burner flame and hot combustion product gases into the inlet of the heat exchanger. An inducer assembly comprising an induced air blower or fan may also be positioned within the vestibule chamber in order to draw combustion products from the heat exchanger outlet and discharge them to vent ducting, thence to a chimney. The vestibule chamber may also contain other components conventionally found in such furnaces, such as a control box containing electronic or other control components for controlling the operation of the furnace.

The present invention provides a single furnace design which is flexible enough to be positioned either vertically or horizontally, in either an upflow or downflow configuration of the primary airflow path when vertically positioned, and, when horizontally positioned, with either left-hand or right-hand side venting in combination with either left-hand or right-hand side direction of the primary airflow path. The furnace housing or cabinet is of essentially rectangular configuration and is so constructed that any of the outlet side, inlet side and two opposite lateral sides may serve as the base of the furnace, that is, may serve as the side or end of the housing which is seated upon the floor, platform or other support on which the furnace is mounted. The furnace of the present invention thus lends itself to installation in any of several orientations and airflow and vent discharge configurations, thereby enabling the replacement of an inventory of different furnace designs with a single design. Specifically, the furnace of the present invention is capable of being installed in six different combinations of primary airflow and flue gas venting, as described more fully below.

The advantages of the present invention derive from a combination of features including the configuration of the inducer assembly, which is dimensioned and configured so that the inducer outlet may be selectively oriented within the housing upon installation of the unit. Therefore, the installer may determine at the installation site which way the inducer outlet is to be oriented within the furnace housing to accommodate the type of installation desired. For example, the inducer assembly may be configured in such a way that the inducer outlet can be rotated within the vestibule chamber in order to direct the vent (flue gas) discharge in any of a number of desired directions. One of the desired directions of flue gas discharge may extend back through the vestibule chamber for exit from a portion of the furnace enclosure which is remote from the location of the inducer assembly. Accordingly, the vestibule chamber and its contents are dimensioned and configured to accommodate within the vestibule chamber an internal flue duct extension which directs the flue gases emerging from the heat exchanger outlet through the vestibule chamber and out of the housing. The burner assembly, control box and any other components of the furnace which are disposed within or extend into the vestibule chamber are dimensioned, configured and located so as to leave room for the optional flue duct extension.

A furnace according to one embodiment of the present invention is shown schematically in FIG. 1. Furnace 10 comprises a housing 12 which is generally rectangular in configuration in that its height H is greater than its width W. The furnace has (FIGS. 1 and 3) an outlet side O, an inlet side I, a front F, a rear R, and two opposite lateral sides, $S_1$ and $S_2$. The "outlet side" and "inlet side" nomenclature refers to the primary airflow path through the furnace. Thus, primary air (air to be heated by the furnace) enters the furnace 10 through a suitable primary air inlet 13 (FIG. 6) in inlet side I and the heated air exits furnace 10 through primary air outlet 21 (FIG. 1). The "lateral sides" of furnace 10 are the two sides which define a part of all three (blower, heat exchange and vestibule) chambers. Housing 12 is constructed with sufficient rigidity and structural strength, and the components supported within it are so mounted as to be secured in place in all different orientations of furnace 10. Thus, "drop-in" mounting of components is not utilized and all components are secured in place within the furnace housing 12 by suitable fastening means so that they remain securely in place in all orientations of the furnace, e.g., "upside down", "sideways", etc. Accordingly, furnace 10 may be positioned with any of outlet side O, inlet side I, lateral side $S_1$ and lateral side $S_2$ serving as the base of the furnace, i.e., as the side or end of the furnace which is seated upon the floor or other support on which the furnace is mounted.

Figure 7:
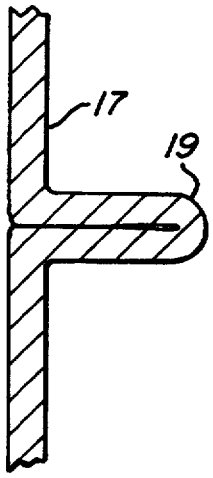
FIG. 7 is a cross-sectional view on a scale greatly enlarged with respect to the other Figures, showing a hem roll formed in sheet metal to provide a support flange.

As may be appreciated with respect to FIG. 1, the many interior components of the furnace disposed within rectangular housing 12 are mounted to the housing by means of mounting flanges. Conventionally, angle brackets of L-shaped profile are mounted by welding, riveting, or otherwise suitably fastening one leg of a right-angle angle iron to the housing so that the other leg protrudes into the housing at a right angle to the wall or other structure to which the angle iron is secured. The protruding leg thus provides a seat upon which a furnace component, e.g., a blower deck, the heat exchanger, etc., is mounted. However, a preferred method of providing such mounting flanges is to form the flanges integrally on the housing body or other sheet metal structure by rolling a right-angle reverse-fold into the sheet metal. This may be accomplished while the housing or other interior wall structure is being formed from sheet metal stock by passing the sheet metal through a series of rollers which form a progressively deeper and steeper crease in the sheet metal and then roll the opposite sides of the crease together to form a hem roll in the sheet metal. The results of such a process is that the sheet metal 17 has a protruding hem roll flange 19, illustrated in cross section in FIG. 7, integrally formed therein and to which any of various internal components of the furnace, including an interior door, can be mounted by rivets, threaded fasteners, welding or the like.

Referring again to FIG. 1, housing 12 contains three principal chambers, a blower chamber 14 wherein is disposed a primary air blower 16; a heat exchange chamber 18 wherein is disposed a heat exchanger 20 and a vestibule chamber 22 wherein is disposed an inducer assembly 24 and other components of the furnace. The three chambers are defined by portions of housing 12 and by an interior wall 26 which extends in housing 12 from inlet side I to outlet side O and by a blower deck 28 which establishes the division between blower chamber 14 and heat exchange chamber 18. Blower deck 28 has a primary air transfer opening 30 through which primary air is forced under the impetus of blower 16 into heat exchange chamber 18. Blower deck 28 extends only from rear side R to wall 26, rather than all the way to the front side F of the housing 12. In this way, blower deck 28 does not truncate vestibule chamber 22, which extends along both the heat exchange chamber 18 and the blower chamber 14. The operating speed of blower 16 may be conveniently changed without the need for service personnel to gain access to blower chamber 14 by provision of a suitably wired plug mounted within vestibule chamber 22 and connected to the motor which drives primary air blower 16.

Air to be heated is flowed by blower 16 along the primary airflow path which is indicated by the arrows P in FIG. 1. The primary airflow path P within furnace 10 is via primary air inlet 13 (FIG. 6) from blower chamber 14 through airflow transfer opening 30 (FIG. 1) connecting blower chamber 14 in airflow communication with heat exchange chamber 18, thence through heat exchanger 20 and out of the primary air outlet 21 formed in outlet side O of the housing 12. The primary air outlet 21 is, upon installation of furnace 10, coupled to a conventional outlet duct (not shown) through which the heated air is transferred to the area to be heated. Interior wall 26 seals off blower chamber 14 and heat exchange chamber 18 from vestibule chamber 22.

Within the primary airflow path in heat exchange chamber 18 is disposed a heat exchanger 20, which in the illustrated embodiment is of the fire tube type and comprises a plurality of hollow, metal tubes **20*a*, 20*b* through which hot combustion products from the burning of a fuel such as natural gas are flowed. The flame and combustion products generated by the burners are introduced into fire tubes 20*a* to heat the tubes, and the air passing in the primary airflow path past and around the tubes is heated by the indirect heat exchange from the hot combustion product gases flowed through the heat exchanger. In accordance with one aspect of the invention, it is advantageous for the tubes 20a, 20b of heat exchanger 20 to be designed so as to eliminate or at least significantly reduce the accumulation of condensate moisture within the tubes. Thus, heat exchangers which include a header box for connecting the large diameter and small diameter fire tubes are less desirable for use in the furnace of the present invention because such header boxes tend to collect condensate. This is especially so in the furnace of the present invention which may be oriented in several different positions, including "upside down" and horizontally. Moisture which condenses within the fire tubes upon cooling of the fire tubes during a period when the burners are shut off will tend to corrode the tubes if left standing in a trapped "pool" of condensate for prolonged periods. The fire tube design illustrated in FIG. 1** of the drawings is the subject of co-pending patent application Ser. No. 07/921,917, assigned to the assignee of this application. The illustrated design provides a substantially self-draining construction whereby condensate tends to drain from the fire tubes or at least not collect in pools but rather be dispersed in thin films of moisture which tend to evaporate. By thereby avoiding the collection of pools of condensate, adverse corrosion effects are eliminated or at least reduced.

The portion of housing 12 which participates in defining vestibule chamber 22 includes an outer door 27 at the front of furnace 10 where it is mounted to furnace housing 12. Preferably, door 27 and the opening into which it fits is dimensioned and configured so that it may easily be removed, rotated end to end (180°) and remounted on housing 12 so that labels and instructions affixed to door 27 can be read regardless of whether furnace 10 is installed as an upflow or downflow furnace, e.g., whether furnace 10 is oriented as shown in FIGS. 1 and 5B with outlet side O facing upwardly or as shown in FIG. 5E with outlet side O facing downwardly. This feature is especially useful when door 27 bears written information such as use instructions or emergency shut-off procedures which should be easily readable at all times.

As discussed above, various components of the furnace are disposed within vestibule chamber 22. For example, a burner assembly 32 provides the hot combustion products which pass through heat exchanger 20. Burner assembly 32 may comprise a burner manifold 34 to distribute fuel such as natural gas to the various individual burners and may further comprise associated devices such as a safety shut-off control valve, an igniter, etc. One such associated device is the safety control box 36 shown in FIG. 1, which monitors the operation of the furnace and which can effect an emergency shut-off should conditions so require.

The first legs of the fire tubes in heat exchanger 20, which extend from the burner assembly to the first upward bend in the tubes, may be foreshortened so that wall 26 may be configured with a recess 38 to accommodate burner assembly 32. By disposing burner assembly 32 at least partially within recess 38, more room is left in vestibule chamber 22 to accommodate an internal flue duct, as discussed below. Wall 26 may also comprise a blower access door 40 to provide access to blower 16 for maintenance and/or repair.

Figure 2A:
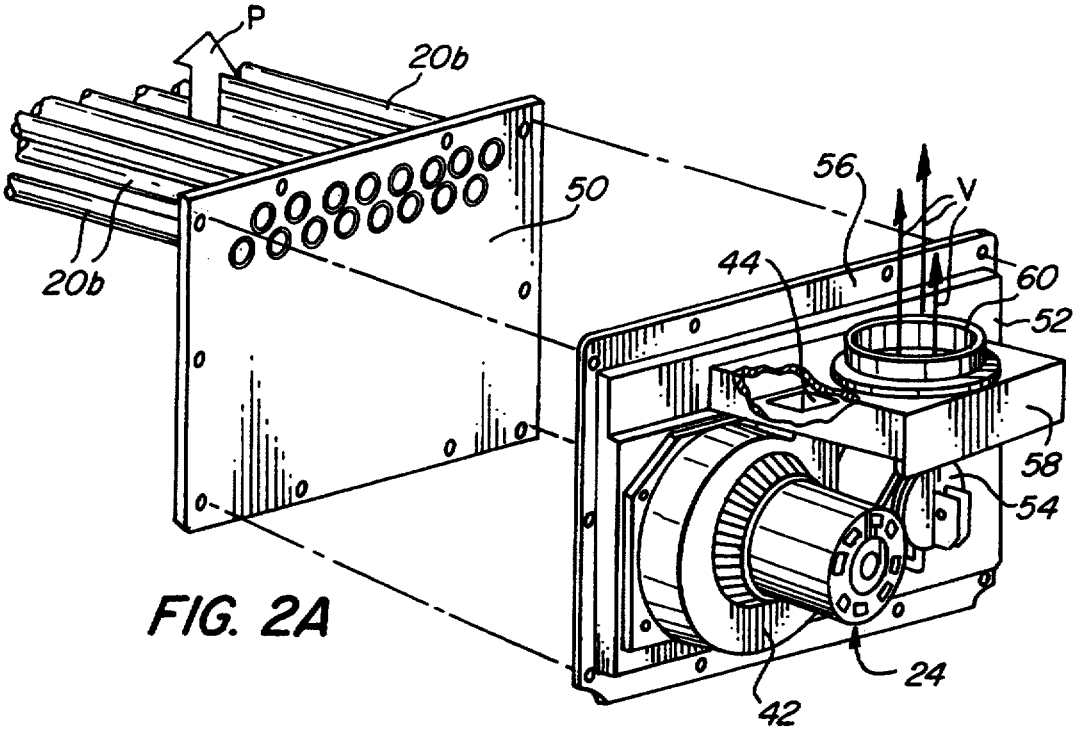
FIGS. 2A and 2B are exploded schematic perspective views of the inducer assembly and heat exchanger outlet of the furnace of FIG. 1, showing the inducer assembly in two different relative orientations.

As shown in FIG. 1, inducer assembly 24 comprises a draft inducer 42 having an inducer outlet 44 which is disposed upwardly. FIG. 2A is an exploded view of inducer assembly 24 and heat exchanger outlet 50. Heat exchanger outlet 50 is accessible from vestibule chamber 22 by means of an opening (not shown) in wall 26. Heat exchanger outlet 50 receives and commingles the combustion products emitted from the fire tubes in heat exchanger 20.

Inducer assembly 24 comprises an inducer pan 52 on which is mounted draft inducer 42 and a pressure switch 54. Inducer pan 52 is equipped with a peripheral flange 56 which is dimensioned and configured to mate with heat exchanger outlet 50 and to be secured thereon by releaseable coupling means. Such releaseable coupling means may comprise releasable clamps configured to press flange 56 to heat exchanger outlet 50, or may comprise threaded fasteners such as bolts which pass through an array of aligned, threaded holes in flange 56 and heat exchanger outlet 50. Inducer assembly 24 is shown with a flue box 58 thereon, flue box 58 being dimensioned and configured to couple with the inducer outlet 44 on one side and, by means of circular flange 60, with a conventional cylindrical flue duct on the other side. As illustrated in FIGS. 1 and 2A, inducer assembly 24 is oriented so that the inducer outlet 44 and circular flange 60 discharge combustion products upwardly, in the direction of line arrows V.

Figure 2B:
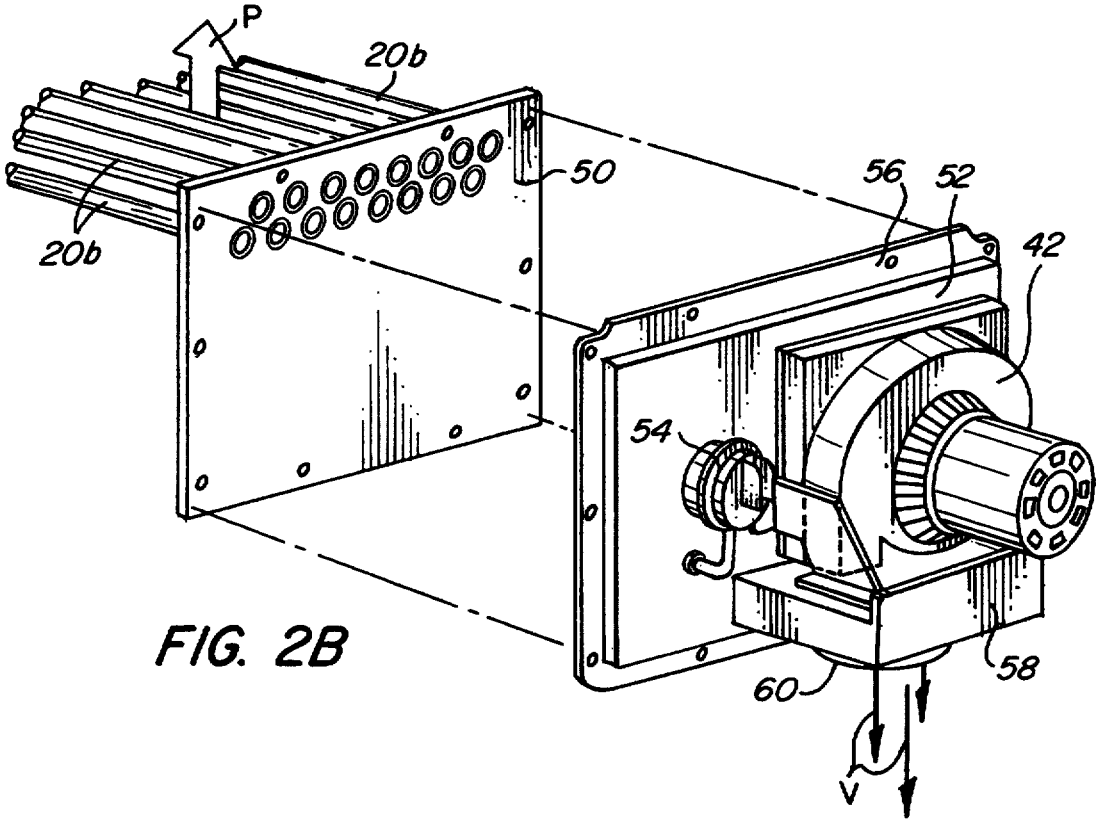

As seen in FIGS. 2A and 2B, heat exchanger outlet 50 and inducer pan 52 both have a central, two-fold axis of rotational symmetry. Accordingly, inducer assembly 24 may be temporarily removed from heat exchanger outlet 50, rotated 180° about the axis of symmetry of inducer pan 52, as shown in FIG. 2B, and replaced in engagement with heat exchanger outlet 50. In the embodiment shown, the threaded bolt holes are disposed in a pattern along flange 56 and heat exchanger outlet 50 such that upon reversal of inducer assembly 24 from its position shown in FIG. 2A to that as shown in FIG. 2B, the holes align with their rotational counterparts and inducer assembly 24 may be secured to heat exchanger outlet 50 in either rotational orientation to direct the flue gas upwardly or downwardly as desired.

In order to permit discharge of flue gases from furnace 10, vestibule chamber 22 is provided with a flue vent opening 48. In the arrangement of FIG. 1, the flue vent opening is provided by locating at the outlet side O of vestibule chamber 22 a vestibule chamber flue plate 46 having a flue vent opening 48 formed therein to accommodate a flue to be coupled to inducer outlet 44 for discharging combustion products from the heat exchanger as flue gas, as indicated by the arrows V. A vestibule chamber closure plate 46' closes off the opposite end of vestibule chamber 22 at the inlet side I of the furnace 10. Plates 46 and 46' are identical in size and configuration, except that plate 46 has no flue vent opening formed therein, so that the two plates 46 and 46' may be interchanged when it is desired to discharge the flue gases from inlet side I of furnace 10. The location of flue vent opening 48 when vestibule chamber flue plate 46 is located at the inlet side I of furnace 10 is shown in phantom line rendition in FIG. 1. The repositioning of flue plate 46 by interchanging it with closure plate 46' allows for flue vent opening 48 to be moved between a position on the outlet side O of housing 12 to the inlet side I of housing 12. The two opposite end portions of vestibule chamber 22 in which flue plate 46 and its flue vent opening 48 may be installed by interchange with closure plate 46' define a "discharge section", as that term is used in the claims. In an alternate construction to that illustrated in the Figures, instead of switching the location of flue plate 46 and closure plate 46' to provide access for the external vent duct 62 or the internal flue duct 64 through the furnace enclosure, knock-out plates corresponding to flue vent opening 48 (illustrated in solid and phantom lines in FIG. 1 to show its two available locations) could be provided. The knock-out plate would be removed from either the inlet side I or outlet side O of vestibule chamber 22 as desired.

Figure 3:
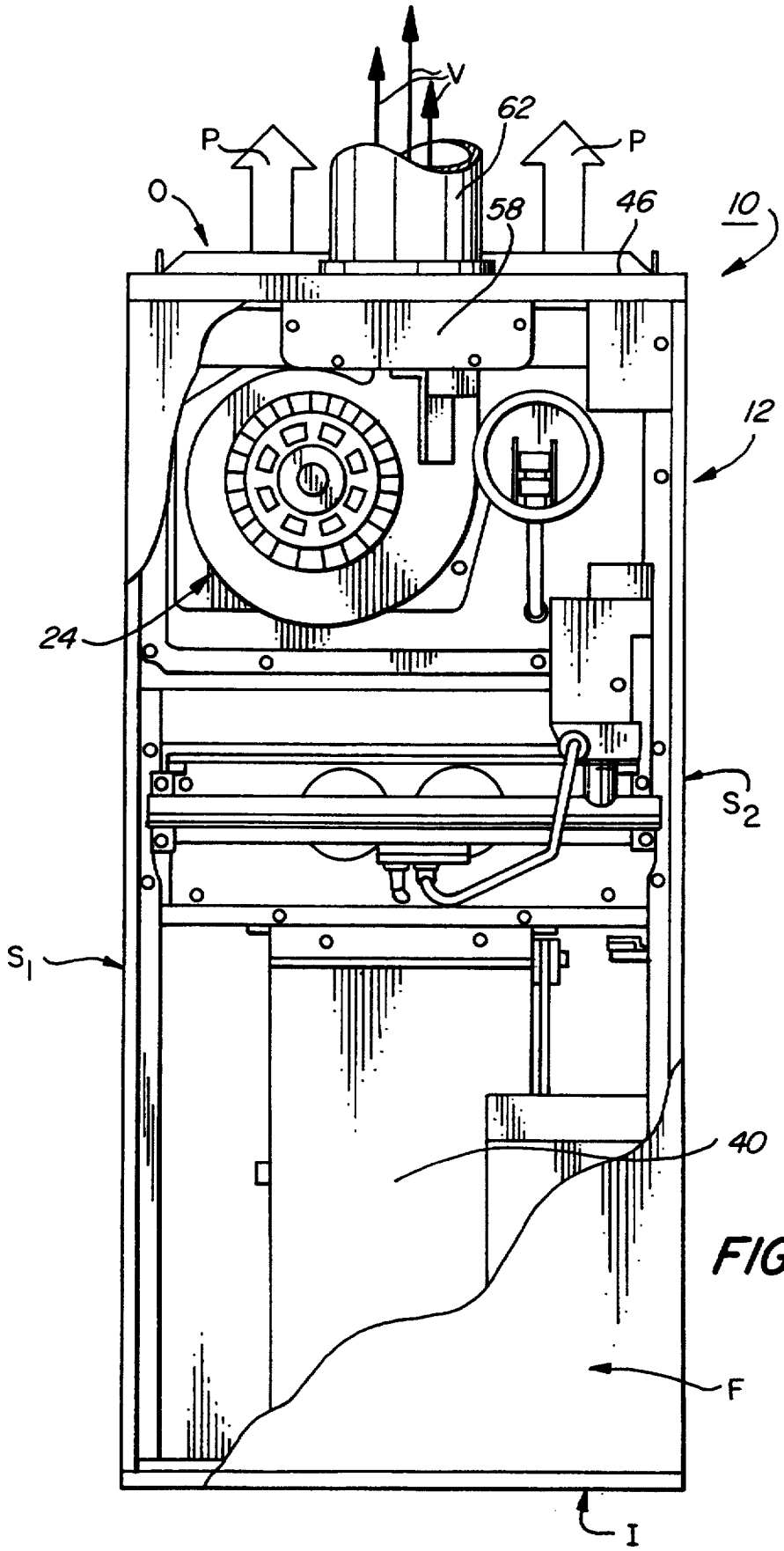
FIG. 3 is a front elevational view of the furnace of FIG. 1 with the front panel broken away and wherein the furnace is disposed in an upflow orientation with the inducer outlet disposed upwardly.

It will be seen that furnace 10, as shown in FIGS. 1 and 3 is oriented as an upflow furnace in which inducer assembly 24 is oriented so that inducer outlet 44 is disposed upwardly. The primary airflow path in this and other Figures is indicated by the outlined arrows P, whereas the flow of combustion products (flue gas) to venting is represented by the line arrows V. In the upflow configuration of FIG. 3, flue box 58 couples inducer outlet 44 to an external vent duct 62 through flue plate 46.

Figure 4:
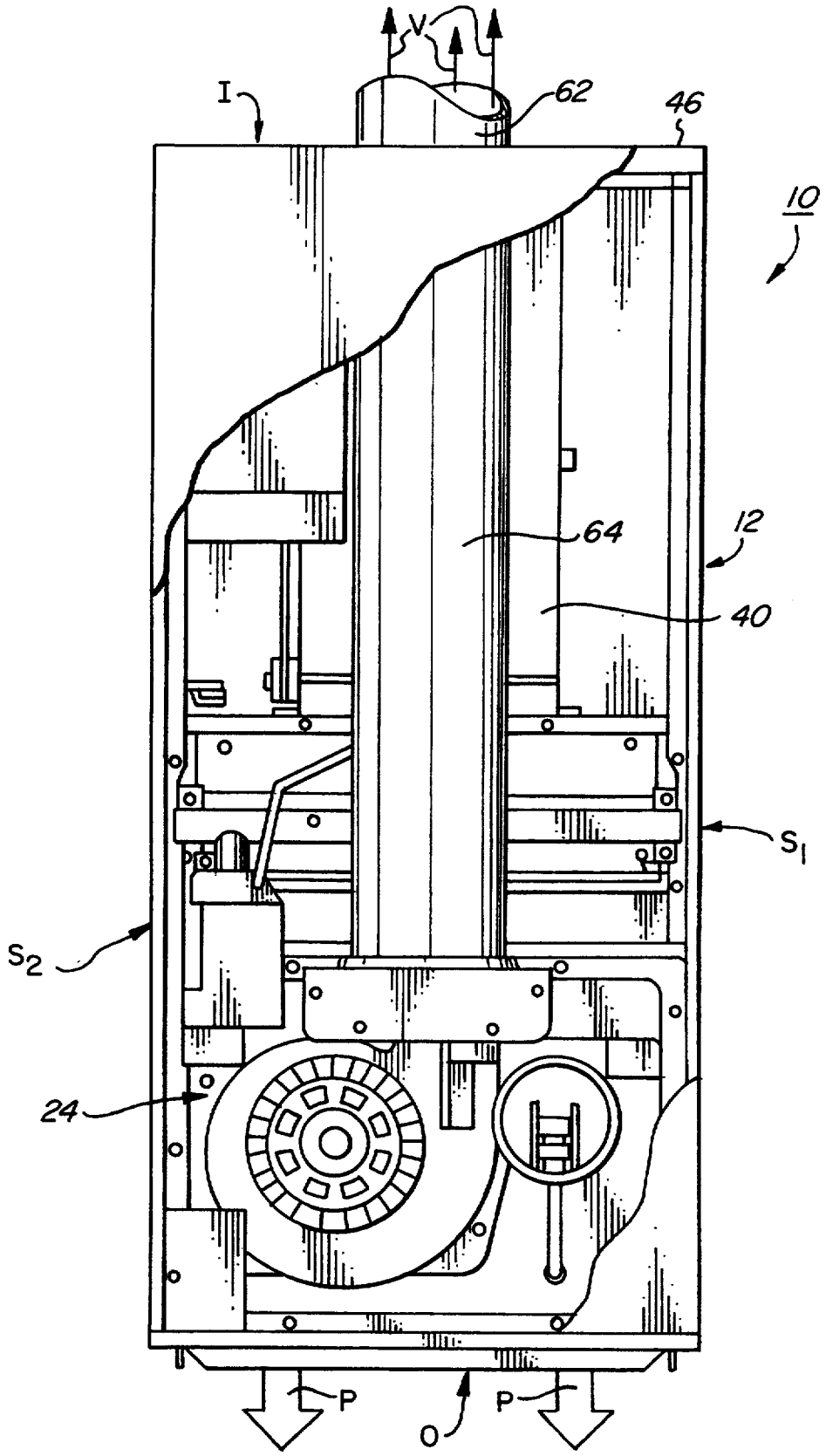
FIG. 4 is a front elevational view of a furnace according to another embodiment of the present invention with the front panel broken away and wherein the furnace is disposed in a downflow orientation with the inducer outlet disposed upwardly.

The flexibility afforded by the furnace of the present invention is illustrated by its ability to be installed in other configurations. However, regardless of the orientation, the direction of the primary airflow path P does not change with respect to housing 12. In the configuration of FIG. 1 (and FIGS. 3 and 5B), the furnace 10 is oriented vertically with outlet side O facing upwardly, and the primary airflow path discharges heated air through the outlet side O of housing 12; so oriented, furnace 10 serves as an "upflow" furnace. When oriented as shown in FIGS. 4 and 5E, furnace 10 is oriented vertically with inlet side I facing upwardly and outlet side O facing downwardly, and the furnace 10 serves as a "downflow" furnace. FIGS. 5A, 5C, 5D and 5F show the furnace oriented horizontally for use as a horizontal flow furnace. The direction, right or left, of horizontal primary airflow and horizontal venting of flue gases describes the direction of flow as sensed when facing the vestibule chamber side of the furnace, i.e., from the front side F of the furnace. It should be noted that all six configurations of FIGS. 5A–5F are attainable without necessity of structural design differences in the configuration of the furnace. That is, the same furnace may be installed in any and each of the six configurations illustrated in FIGS. 5A through 5F.

It is a simple matter to change the direction of venting of flue gases from the outlet of inducer assembly 24. This is attained upon installation by disengaging inducer assembly 24 from heat exchanger outlet 50 (FIGS. 2A and 2B), rotating inducer assembly 24 180° as illustrated in FIGS. 2A and 2B, and reengaging inducer assembly 24 with heat exchanger outlet 50. Flue plate 46 is removed from the outlet side O of furnace 10 and is remounted on the inlet side I of furnace 10, now disposed upwardly. (FIG. 1 shows flue vent opening 48 in dotted outline on inlet side I of the furnace 10.) As discussed above, vestibule chamber 22 and the furnace components thereon are dimensioned, configured and situated to accommodate an internal flue duct 64 which will guide combustion products from inducer assembly 24 through vestibule chamber 22 to the external vent duct 62, again indicated by the line arrows. So configured, the flow of combustion products through housing 12 indicated by line arrows V, is still parallel to the primary airflow path (arrows P) but in the opposite direction. Thus, furnace 10' of FIG. 4 is oriented as a downflow furnace having a top vent discharge.

Figure 5A:
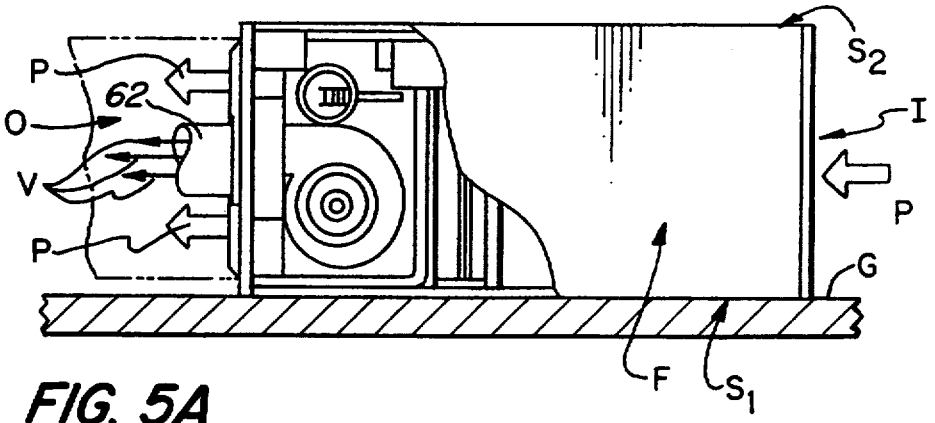
FIGS. 5A through 5C are schematic front elevational views (on a reduced scale compared to FIG. 1) of different configurations of the furnace of FIG. 1, in which the direction of flow of heated air in the primary path is the same as the direction of discharge of vent gases from the inducer outlet and the furnaces are in different orientations.
Figure 5B:
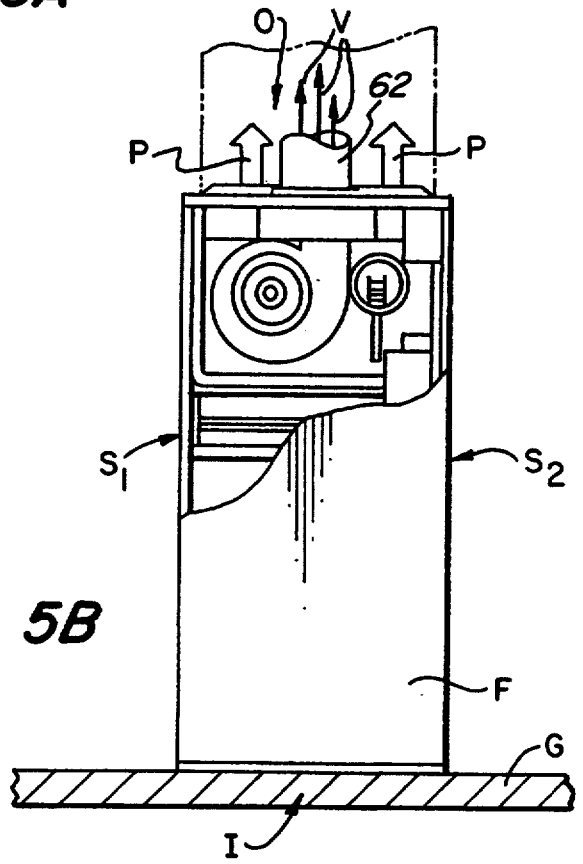
Figure 5C:
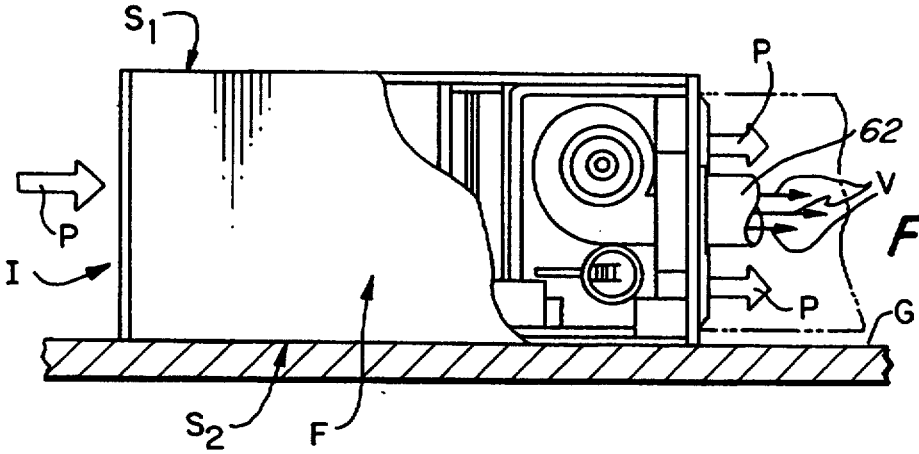
Figure 5D:
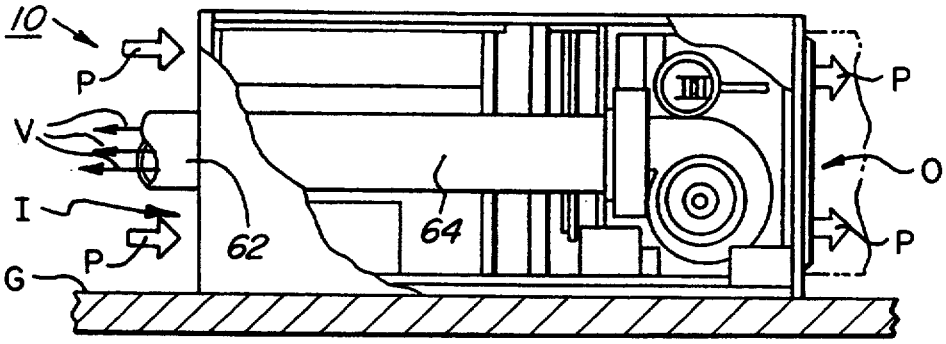
FIGS. 5D through 5F are schematic front elevational views (on a reduced scale compared to FIG. 1) of different configurations of the furnace of FIG. 1, in which the direction of flow of heated air in the primary path is opposite to the direction of discharge of vent gases from the inducer outlet and the furnaces are in different orientations.
Figure 5E:
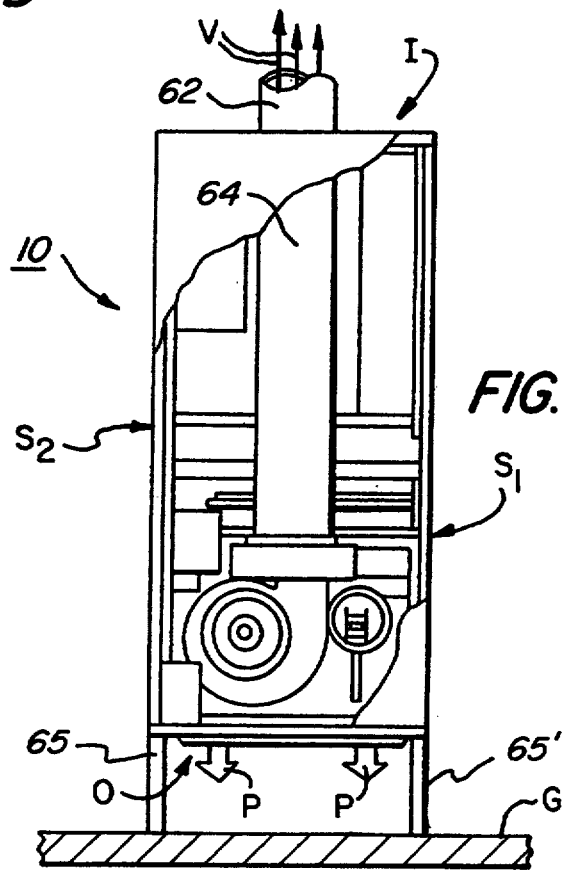
Figure 5F:
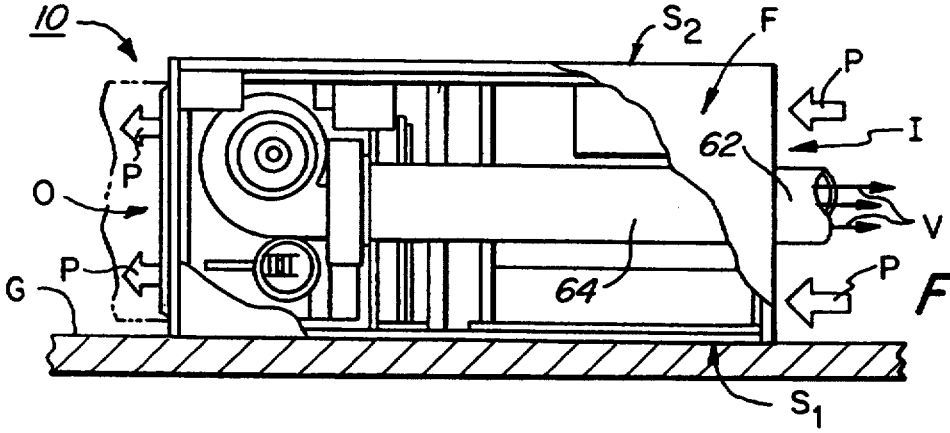

It will be seen from the schematic representations of FIGS. 5A through 5F that the present invention provides a furnace which may be disposed in at least six different configurations. In FIGS. 5A–5F, the ground or other surface on which the furnace 10 is carried is indicated at G. For example, FIG. 5A shows the furnace 10 having a horizontal left-airflow and a left vent discharge. By standing the furnace of FIG. 5A on end, as shown in FIG. 5B (and FIG. 1) furnace 10 may be employed as an upflow furnace having a top vent discharge. Likewise, by disposing furnace 10 as shown in FIG. 5C, a horizontal right-airflow furnace having a right vent discharge is attained. The furnace configurations of FIGS. 5A–5C all have the vent discharge (arrows V) emanating from the outlet side O of furnace 10. However, according to the present invention, inducer assembly 24 is re-positionable, e.g., reversible, within housing 12 and vestibule chamber flue plate 46 (in which flue vent opening 48 is formed) can be interchanged with vestibule chamber closure plate 46' (which has no opening therein). When flue plate 46 is installed at the inlet side I of vestibule chamber 22, as in the configurations of FIG. 5D–5F, internal flue duct 64 is secured in place to connect the inducer assembly outlet in flow communication with vent opening 48. Accordingly, by simply revising (relative to the configuration of FIGS. 5A–5C) the orientation of the inducer assembly 24, interchanging flue plate 46 and closure plate 46' and connecting internal flue duct 64, three additional configurations are possible, as shown in FIGS. 5D through 5F. The configuration of FIG. 5D, like that of FIG. 5C, is a horizontal right-airflow furnace, but in contrast to the furnace of FIG. 5C, furnace 10 of FIG. 5D provides a left vent discharge. FIG. 5E shows a downflow furnace having a top vent discharge. In the case of the configuration of FIG. 5E, furnace 10 is spaced from the ground or other support indicated at G by support vestibules 65, 65' in order to provide clearance for the outlet airflow indicated by arrows P. Alternatively, an air outflow duct could be cut through support G to connect to the primary air outlet (item 21 in FIG. 1). FIG. 5F shows a horizontal left-airflow configuration having a right vent discharge. Thus, a single furnace according to the present invention may be disposed in at least six different configurations with need for minor installation site adjustments. A versatile furnace line is thus provided by a single furnace design and obviates the need to manufacture and keep in inventory different furnace designs.

To provide a furnace which is even more adaptable to the constraints of installation sites by virtue of its reduced size, another aspect of the present invention provides that blower 16 is designed with a scroll housing which permits a reduction in the size of blower chamber 14 and a shortening of vestibule chamber 22, thus reducing the height H of the furnace as shown in FIG. 1. This reduction in size is achieved as follows.

Figure 6A:
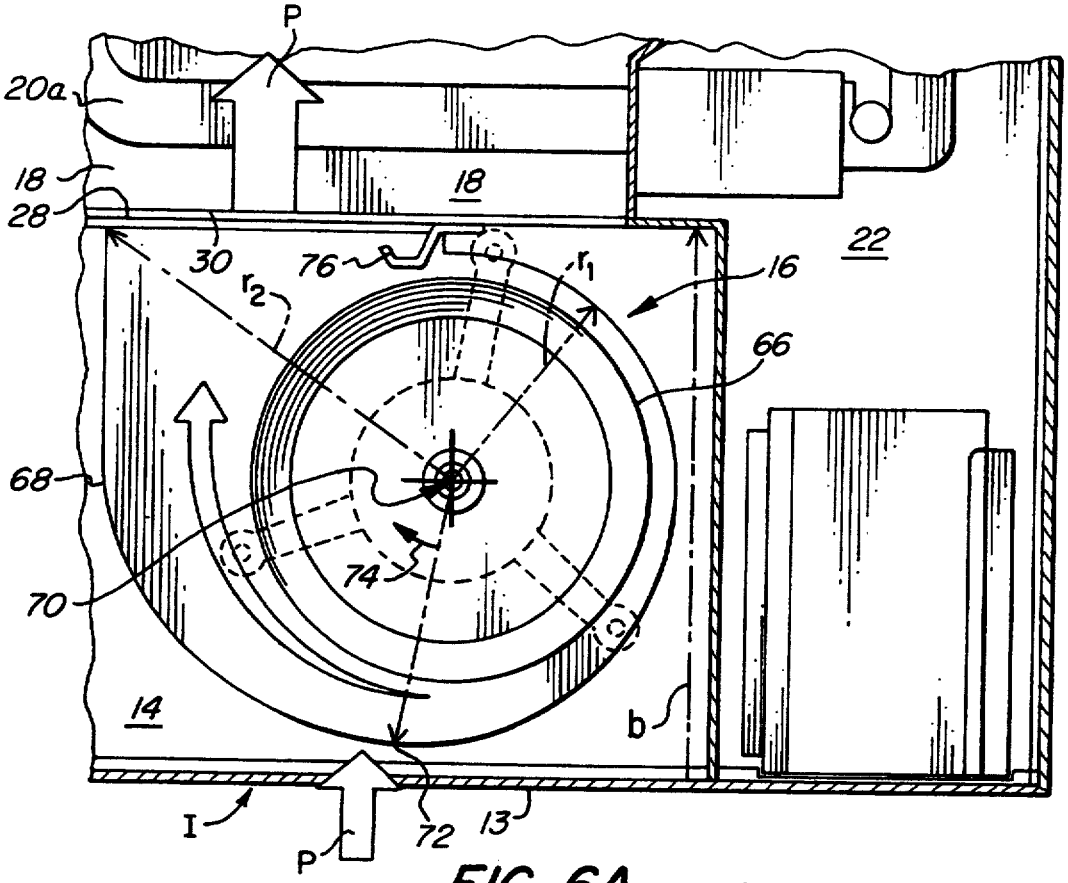
FIG. 6A is a schematic cross-sectional view of a primary blower having a scroll housing configuration according to another aspect of the present invention.
Figure 6B:
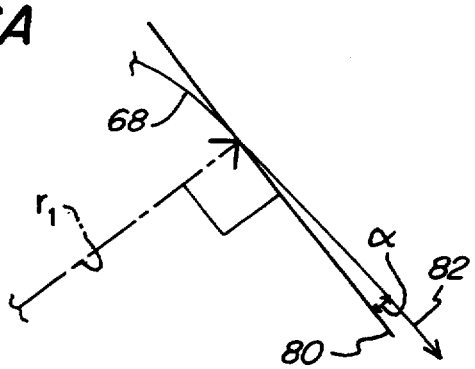
FIG. 6B is an enlarged view (not to scale) of a portion of the scroll housing shown in FIG. 6A.

As seen in the schematic cross section of FIG. 6A, blower 16 comprises a conventional "squirrel cage" fan 66 which is rotatably mounted within a scroll housing 68. Fan 66 is driven by a motor (not shown) and draws air into the blower housing 14 and forces the air into heat exchange chamber 18 in the primary airflow path indicated by arrows P. Scroll housing 68 has a cross section which may be described as defining a curve which increases in radius from a center point 70 at the center of rotation of fan 66. The scroll housing begins near the blower outlet at a minimum distance or radius from point 70 indicated by $r_1$, but the radius increases with angular displacement about point 70, until the scroll housing reaches a maximum radius $r_2$ at the blower outlet. Conventional scroll housings have one of two configurations: a standard scroll or a tight scroll, the difference being in the magnitude of the expansion angle of the curve of the housing. The expansion angle of the curve is the angle, relative to a line perpendicular to the radius of the curve of the housing at a given point, of a tangent of the curve at that point. By way of example, a circle defines a curve having an expansion angle of zero, since all tangents to a circular curve extend at right angles from the corresponding radii. Correspondingly, the radius of a circle is the same in all directions from the center. Conventional scroll housings typically have a constant positive (i.e., greater than zero) expansion angle corresponding either to a tight or a standard scroll. Accordingly, the radius of a scroll housing increases as the curve of the housing extends about its center point to the outlet. The outlet of conventional scroll housings is either standard in size relative to the fan, in the case of a standard scroll, or smaller in size, corresponding to a tight scroll. The Applicants have observed that the portion of the scroll beginning with the smallest radius $r_1$ and ending where the scroll curve is parallel to the bottom of the housing, i.e., at point 72, determines the height b of blower chamber 14. In a housing scroll according to the present invention the expansion angle, and therefore the rate of increase of the radius of scroll housing 68 in this first portion of the scroll, is small, i.e., the scroll has a tight expansion angle. Thus, a tangent to the curve of housing 68 at the point where $r_1$ intersects the curve, e.g., tangent 80 of FIG. 6B, establishes a small expansion angle $\alpha$ with respect to line 82 which is perpendicular to $r_1$ at the intersection point on the curve. Accordingly, height b is reduced in comparison to a standard scroll, which in turn reduces height H of the furnace. This scroll portion, which is tighter than a standard scroll, may be described as a "tight scroll portion". With further angular displacement about point 70 beyond point 72, as indicated by arrow 74, the curvature of scroll housing 68 is directed upward, and therefore no longer affects the height b of blower chamber 14. Accordingly, in the portion of the curve between point 72 and $r_2$, the radius of the scroll according to the present invention increases at a greater rate than before, i.e., this portion of the scroll has an expansion angle greater than that of the tight scroll portion, and preferably greater than that for a standard scroll, providing in either case a "loose scroll portion" of the housing. The rate of radius increase of a particular embodiment of the scroll is drawn accurately to scale in FIG. 6A. Despite having a tight scroll portion from radius $r_1$ to point 72 and the associated diminished height, a fan housing according to this aspect of the invention can have a near-standard size outlet because of the loose scroll portion of the housing extending from point 72 to the outlet, which expands the radius without adding to the height of the housing. Thus, a blower housing according to the present invention has a tight scroll portion and a loose scroll portion. Such a scroll housing affords the performance advantages of a standard scroll housing without unnecessarily adding to the height H of the furnace, which is now reduced by virtue of the tight scroll portion of scroll housing 68.

The installation of blower 16 within furnace 10 may be simplified by providing a slide-in connection of the blower to the blower deck. In this regard, the outlet edge of scroll housing 68 of blower 16 may comprise a peripheral flange dimensioned and configured to engage alternating flanges 30*a*, 30*b* (FIG. 8) disposed about the primary air transfer opening 30 formed in blower deck 28. Flanges 30*a*, 30*b* are dimensioned and configured to slidably but securely receive the peripheral flanges about the outlet of blower 16. Therefore, blower 16 may be mounted onto blower deck 28 simply by disposing blower primary air transfer opening 30 against blower deck 28 and sliding the peripheral flange in the direction shown by arrow a in FIG. 8, to lock blower 16 into place with the blower outlet aligned with the primary air transfer opening 30.

Figure 8:
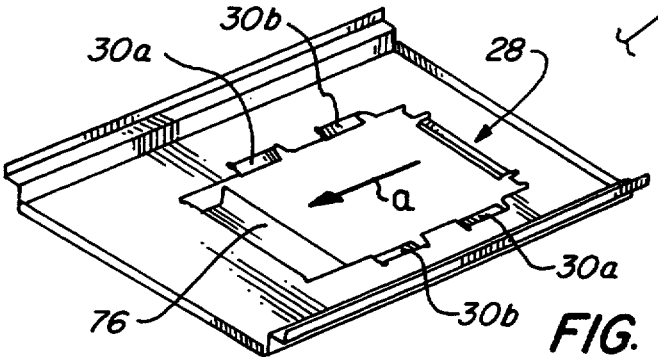
FIG. 8 is a perspective view of the blower deck of the furnace of FIG. 1.

As is known in the art, it is useful to provide a barrier to airflow between the outlet of the blower and the narrow portion of the scroll, sometimes referred to as a blower scroll cutoff. In some blowers according to the prior art the scroll housing is dimensioned and configured to approach the fan at the point of the smallest radius to provide the scroll cutoff. However, in one embodiment of a furnace according to the present invention, the blower scroll cutoff 76 may be provided by a flange attached to or formed integrally with blower deck 28, as illustrated in FIG. 8, and which extends into the blower outlet, terminating near the fan.

While the invention has been described in detail with reference to particular embodiments thereof, it will be apparent that upon a reading and understanding of the foregoing, numerous alterations of the described embodiment will occur to those skilled in the art and it is intended to include such alterations within the scope of the appended claims.

What is claimed is:

1. In a forced air furnace comprising (a) a housing defining an outlet side, an inlet side disposed opposite to the outlet side and a pair of oppositely disposed lateral sides, within which housing is disposed (b) a burner assembly, (c) a heat exchange chamber, (d) a heat exchanger disposed within the heat exchange chamber and having an exchanger inlet positioned to receive therein hot combustion product gases generated by the burner assembly and an exchanger outlet for discharge of the combustion product gases therefrom, (e) a blower chamber, (f) a primary air blower disposed within the blower chamber for forcing air in a primary airflow path through the heat exchange chamber in indirect heat exchange relationship with the heat exchanger, (g) a vestibule chamber extending adjacent to the heat exchange and blower chambers, (h) an inducer assembly disposed within the vestibule chamber and comprising an inducer blower and an inducer outlet, the inducer assembly being coupled in gas flow communication with the exchanger outlet for drawing cooled combustion products as flue gas from the heat exchanger, the improvement comprising that:

the inducer assembly is dimensioned and configured to be coupled to the heat exchanger outlet with the inducer outlet disposed in a selected one of a plurality of directions relative to the vestibule chamber, the vestibule chamber is dimensioned and configured to accommodate an internal flue duct coupled to the inducer outlet and extending through the vestibule chamber from the inducer outlet to and through a side of the housing, and the housing is dimensioned and configured so that the furnace may be supported on any one of the outlet side, the inlet side and each of the lateral sides.

2. The forced air furnace of claim 1 wherein the vestibule chamber has a first discharge section and a second discharge section disposed opposite the first discharge section, and the inducer assembly is dimensioned and configured to enable selective placement of the inducer outlet facing toward either the first or second discharge sections.

3. The forced air furnace of claim 2 wherein the first discharge section is disposed adjacent to the heat exchange chamber, the second discharge section is disposed adjacent to the blower chamber and opposite to the first discharge section, and the inducer assembly is disposed adjacent to the first discharge section.

4. The forced air furnace of claim 2 or claim 3 wherein the inducer assembly comprises an inducer pan which mates in gas flow communication with the exchanger outlet, the inducer pan and the exchanger outlet being each dimensioned and configured to have a common axis of symmetry whereby the inducer pan mates with the exchanger outlet in each of two rotational orientation positions of the inducer pan which positions are 180° of rotation apart about the axis of symmetry.

5. The forced air furnace of claim 4 wherein the two positions of the inducer pan respectively dispose the inducer outlet facing in opposite directions, both of which are parallel to the primary airflow path.

6. The forced air furnace of claim 5 wherein the inducer assembly is oriented relative to the heat exchanger outlet so that the inducer assembly discharges the flue gas in the same direction as the primary airflow path.

7. The forced air furnace of claim 5 wherein the inducer assembly is oriented relative to the heat exchanger outlet so that the inducer assembly discharges the flue gas in a direction opposite to the direction of the primary airflow path.

8. The forced air furnace of claim 7 further including the internal flue duct connecting the inducer outlet in combustion product flow communication with the second discharge section.

9. The forced air furnace of claim 4 further comprising releasable coupling means to releasably couple the inducer assembly to the heat exchanger outlet.

10. The forced air furnace of claim 9 wherein the inducer pan comprises a peripheral flange dimensioned and configured to engage the heat exchanger outlet.

11. The forced air furnace of claim 10 wherein the inducer assembly is mounted to the heat exchanger outlet by a plurality of threaded fasteners.

12. The forced air furnace of claim 1, claim 2 or claim 3 including an interior door fitted into a sealable opening between the vestibule chamber and the blower chamber to isolate the vestibule chamber from the blower chamber.

13. The forced air furnace of claim 1 further comprising an outer door wherein the housing and the outer door are dimensioned and configured so that the outer door may be mounted on the housing in each of two rotational orientation positions, which positions are 180° of rotation apart.

* * * * *

UNITED STATES PATENT AND TRADEMARK OFFICE

CERTIFICATE OF CORRECTION

PATENT NO. : 5,368,010

DATED : November 29, 1994

INVENTOR(S) : Richard H. Weber, III et al

It is certified that error appears in the above-indentified patent and that said Letters Patent is hereby corrected as shown below:

In column 3, line 17, replace "inducter" with --inducer--.

In column 7, lines 17-18, replace "Ser. No. 07/921,917" with --Ser. No. 07/922,073, filed July 29, 1992, now U.S. Patent 5,301,654.--.

Signed and Sealed this

Sixteenth Day of May, 1995

*Attest:*

*Attesting Officer*

Bruce Lehman

BRUCE LEHMAN

*Commissioner of Patents and Trademarks*